US008307596B2

(12) United States Patent
Catalano

(10) Patent No.: US 8,307,596 B2
(45) Date of Patent: Nov. 13, 2012

(54) KEY FOR CONNECTION OF MUNTIN OR WINDOW PANE SPACER BARS

(75) Inventor: Vincent R. Catalano, St. Charles, IL (US)

(73) Assignee: Allmetal, Inc., Bensenville, IL (US)

( * ) Notice: Subject to any disclaimer, the term of this patent is extended or adjusted under 35 U.S.C. 154(b) by 112 days.

(21) Appl. No.: 12/563,283

(22) Filed: Sep. 21, 2009

(65) Prior Publication Data

US 2011/0067334 A1 Mar. 24, 2011

(51) Int. Cl.
*E04C 2/38* (2006.01)

(52) U.S. Cl. ..... 52/456; 52/591.2; 52/656.1

(58) Field of Classification Search ..... 52/456, 52/589.1, 591.2, 204.69, 204.71, 205, 208, 52/211, 455, 458, 656.5, 783.1; 403/298, 403/309; 49/380, 505; 206/321, 325
See application file for complete search history.

(56) References Cited

U.S. PATENT DOCUMENTS 3,750,358 A * 8/1973 Lewkowitz ..... 52/204.597
4,296,587 A * 10/1981 Berdan ..... 52/786.1
4,454,699 A * 6/1984 Strobl ..... 52/585.1
4,627,263 A 12/1986 Bayer et al.
4,681,477 A * 7/1987 Fischer ..... 403/298
5,048,997 A * 9/1991 Peterson ..... 403/295
5,099,626 A 3/1992 Seeger
5,154,531 A * 10/1992 Peterson ..... 403/205
5,177,920 A * 1/1993 Rafeld ..... 52/314
5,369,922 A * 12/1994 Hansen ..... 52/204.54
5,439,716 A 8/1995 Larsen
5,487,245 A * 1/1996 Dazo et al. ..... 52/204.61
5,570,548 A * 11/1996 Hopper ..... 52/204.5
5,603,582 A * 2/1997 Loh ..... 403/298
5,679,419 A 10/1997 Larsen
5,836,119 A * 11/1998 Emmanuel ..... 52/204.71
5,907,891 A * 6/1999 Meyer ..... 24/453
6,244,012 B1 * 6/2001 McGlinchy et al. ..... 52/665
6,272,801 B1 * 8/2001 Suh ..... 52/211
6,301,843 B1 * 10/2001 Silverman ..... 52/204.5
6,347,902 B1 * 2/2002 Loh ..... 403/298
6,398,449 B1 * 6/2002 Loh ..... 403/280
6,406,213 B1 * 6/2002 Dohman et al. ..... 403/298
6,425,221 B1 * 7/2002 Reichert ..... 52/456
6,467,226 B2 * 10/2002 Dodson et al. ..... 52/220.1
6,694,701 B2 * 2/2004 Wang et al. ..... 52/783.1
6,761,008 B2 * 7/2004 Chen et al. ..... 52/586.1
6,862,859 B2 * 3/2005 Kronenberg ..... 52/656.9
6,898,914 B2 * 5/2005 Folsom et al. ..... 52/656.8
6,925,767 B2 * 8/2005 Krochmal et al. ..... 52/455
7,010,888 B2 * 3/2006 Tumlin et al. ..... 52/204.56
7,104,021 B2 * 9/2006 Apfelthaler ..... 52/656.9
7,124,546 B2 * 10/2006 Scharff et al. ..... 52/314
7,225,523 B2 * 6/2007 Metcalfe ..... 29/507
7,386,959 B2 * 6/2008 Ouellette ..... 52/204.53
7,628,562 B2 * 12/2009 Annes ..... 403/329
7,685,782 B2 * 3/2010 Pettit et al. ..... 52/204.61
7,694,470 B2 * 4/2010 Schultz et al. ..... 52/204.61
7,716,885 B2 * 5/2010 Reichert ..... 52/204.61
7,748,185 B2 * 7/2010 Davis, II ..... 52/456

(Continued)

*Primary Examiner* — William Gilbert
*Assistant Examiner* — James Ference
(74) *Attorney, Agent, or Firm* — Banner & Witcoff, Ltd.

(57) ABSTRACT

A key member or key for joining muntin or spacer bars in a dual pane window include an insertion end for frictional engagement in the open ended passage of a spacer bar and a projection end comprised of axially extending, spaced prongs that include teeth or serrations that enable interlocking with projecting prongs of a like key member.

21 Claims, 3 Drawing Sheets

U.S. PATENT DOCUMENTS 7,757,455 B2 * 7/2010 Gallagher ..... 52/656.5
7,779,583 B2 * 8/2010 Tyler et al. ..... 52/204.61
7,908,820 B2 * 3/2011 Catalano ..... 52/786.13
8,001,742 B2 * 8/2011 Briese et al. ..... 52/656.8
8,015,763 B2 * 9/2011 McGlinchy ..... 52/204.61
2004/0083678 A1 * 5/2004 Tumlin et al. ..... 52/717.01
2006/0254177 A1 * 11/2006 Wang et al. ..... 52/506.01
2007/0022700 A1 * 2/2007 Gallagher ..... 52/656.9

* cited by examiner

KEY FOR CONNECTION OF MUNTIN OR WINDOW PANE SPACER BARS

BACKGROUND OF THE INVENTION

In a principal aspect the present invention relates to a key connector of the type which is typically manufactured from a cast or molded, resilient material such as glass filled nylon or plastic and which is designed for the purpose of joining open ended spacer bars such as used as muntins used in the manufacture of multiple pane, dual glazed window constructions.

Various prior art patents teach the utilization of spacer bars in combination with double glazed windows. The spacer bars are generally formed from thin metal stock, typically aluminum or stainless steel, which is shaped to fit between spaced, parallel glass panels of a Thermopane type window construction. The spacer bars may have various cross-sectional configurations, for example, such as taught in the following U.S. patents:

U.S. Pat. No. 4,627,263—Method of an Apparatus for Making Spacers for Use in Multiple-Pane Windows or the Like U.S. Pat. No. 5,439,716—Multiple Pane Insulating Glass Unit with Insulative Spacer U.S. Pat. No. 5,679,419—Multiple Pane Insulating Glass Unit with Insulating Spacer U.S. Pat. No. 5,099,626 for Connection for Tubular Muntin Bars, discloses a connector for generally hollow, rectangular cross section, spacer bars useful as muntins in the fabrication of Thermopane type window constructions. All of the aforesaid patents are incorporated herewith by reference.

One of the problems associated with such window constructions is effective connection of the muntin or spacer bars. Typically, the muntin or spacer bars are hollow, and the opposed open ends of the hollow tube forming the spacer bars must somehow be connected or joined together in order for the spacer bars to appropriately perform their desired function. U.S. Pat. No. 5,099,626 and the references cited therein disclose various types of connector mechanisms. Typically, such connector mechanisms or keys are manufactured from a plastic material such as nylon, glass filled nylon, polyethylene or polypropylene. They are designed to simultaneously engage multiple spacer bars by fitting into the hollow open ends of the spacer bars and other openings formed in the spacer bars.

While such constructions have been determined to be useful for their intended purpose of providing a key or connector to join muntin bars, there has remained a need for improved methods and constructions to effect and maintain joinder and to prevent disconnection. Further, it is desirable to have a key or joinder or connector mechanism which is not only rugged and durable, but also which can be utilized easily in the manufacture of such window constructions. Additionally, providing a simple, universal key construction is a desired objective. Such a universal key will enable connection of spacer bars using a minimum number of parts.

SUMMARY OF THE INVENTION

Briefly, the present invention comprises a molded key construction or key comprised of an elongate central rib having wings projecting from opposite sides of the rib and further including various lateral stops, tabs and tang members incorporated with the rib to control insertion of the rib into the open end of a hollow spacer bar that is to be connected to adjoining spacer bars. Various versions of the lateral wings are described. The wings preferably extend laterally outward from the sides of the central rib and form an acute angle with the sides of the rib. Additional elements may also be attached or incorporated with the rib such as shaped, elongate ribs and flanges. In use, the wings are deformed elastically and become wedged into place within a hollow spacer bar. The wings of the key connection are designed primarily for use with rectangular cross section spacer bars. However, the concept may be incorporated with and utilized with spacer bars of any cross sectional configuration inasmuch as the main axial rib may include appropriately shaped and sized wings for cooperation with the spaced walls of various complex configurations of spacer bars.

The keys also employ at least two, elongate, axially projecting, spaced prongs or ribs designed to interlock with projecting prongs of a substantially identical key. The prongs are adequately long to enable their projection into a spacer bar aligned transversely to the keys. Thus, a pair of keys may be used to interlock three spacer bars: i.e., two open ended, opposed spacer bars separated by, but joined to a transverse spacer bar. The keys employ a universal design enabling use of pairs of the key to connect adjacent spacer bars. Each one of the pair of joined keys thus includes an insertion end having wings to frictionally engaged into the hollow end of a spacer bar, and a projection end with projecting prongs or ribs that may pass into a transversely aligned spacer bar and interlock with ribs or prongs of an opposed key.

Thus, it is an object of the invention to provide an improved key construction for connection of hollow spacer bars.

A further object of the invention is to provide a key construction which is rugged, inexpensive and easy to install in order to connect hollow spacer bars.

Another object of the invention is to provide a key construction comprised of a central axial rib having laterally projecting wing members wherein the rib is designed to rigidly fit into the hollow or open end of a spacer bar and further wherein the lateral wings are designed to engage certain sidewalls of the spacer bar and further including prongs or ribs designed to engage similar prongs or ribs of a companion key projecting from an adjacent spacer bar.

Another object of the invention is to provide a spacer bar which enables the free flow of gases around the spacer bar within the hollow tube comprised of connected spacer bars.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF AN EMBODIMENT OF THE INVENTION

Figure 1:
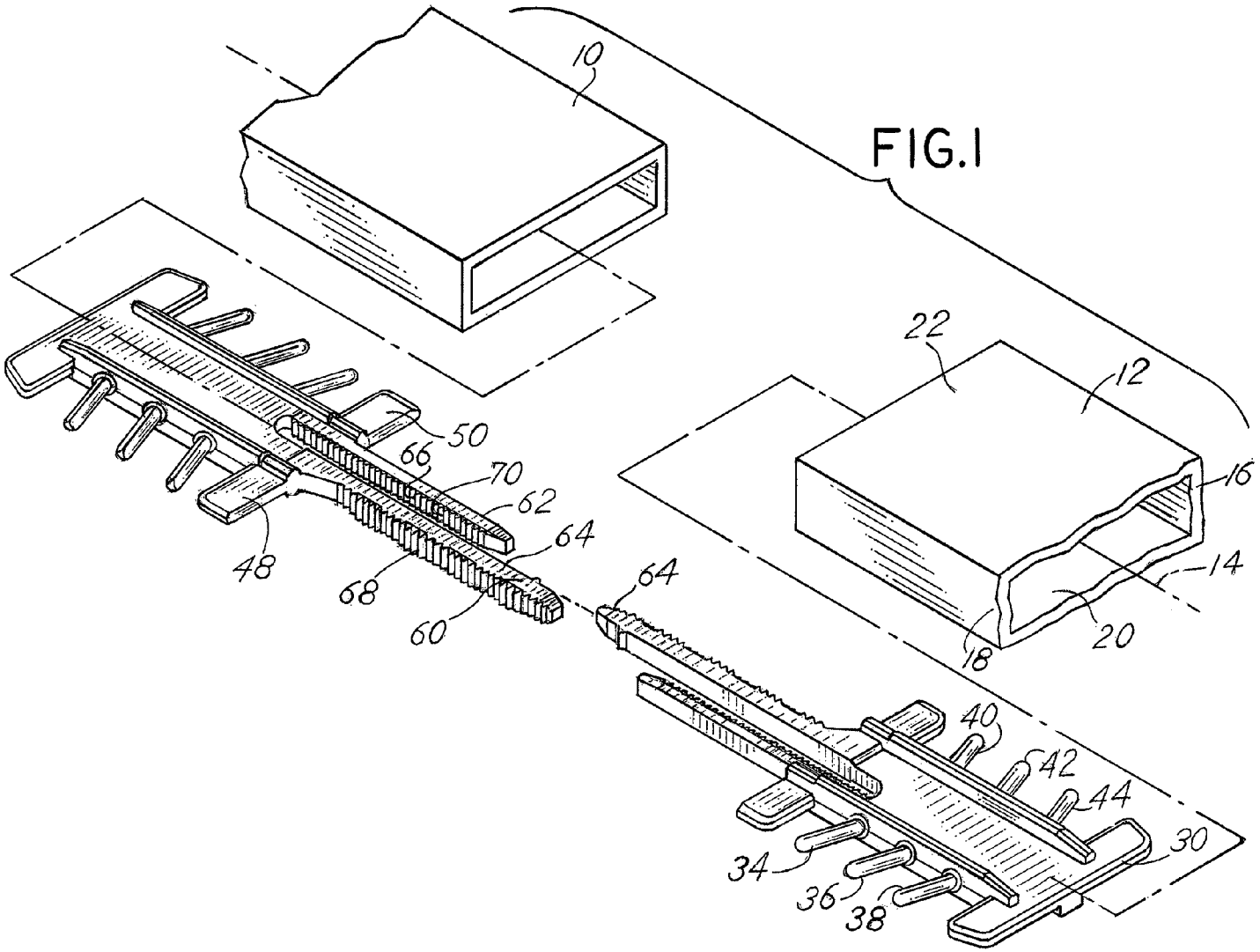
FIG. 1 is an exploded isometric view of first and second muntin or spacer bars with key members construction positioned for being fitted into the hollow end passages of each spacer bar.
Figure 2:
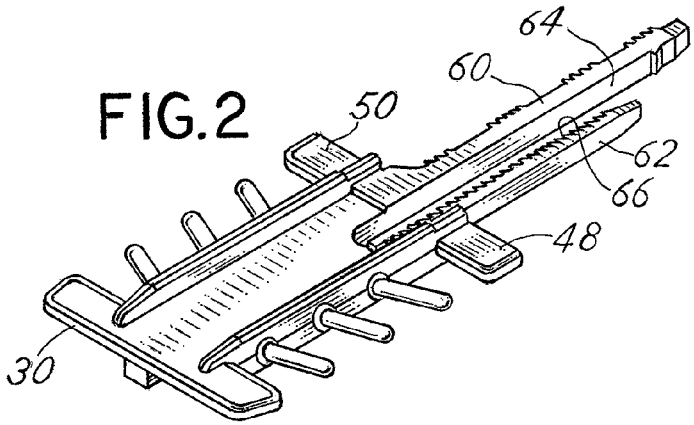
FIG. 2 is an isometric view depicting the construction of a single key member depicted in FIG. 1.

Referring to the figures, and, in particular, FIG. 1 there is depicted, an exploded isometric view of a first hollow muntin or spacer bar 10 and a second hollow muntin or spacer bar 12. The spacer bars 10 and 12 each define an elongate axis 14. The spacer bars 10 and 12 are hollow and typically have a generally rectangular cross sectional shape. The hollow rectangular cross sectional shape is defined by spaced lateral or side walls 16 and 18 which define a width dimension between the inside surface of each of the side walls 16 and 18. Similarly, a bottom wall 20 of spacer bar 10 is spaced from a top wall 22 and the inside surface spacing distance is defined as the height dimension between the interior of the bottom and top walls 20 and 22. Each of the spacer bars 10 and 12 has a similar construction. Of course, in the embodiment shown, the spacer bars 10, 12 have a generally rectangular cross section and the description of the embodiment is set forth in the context of generally rectangular cross sectional shapes of the spacer bars 10, 12. However, the invention is not so limited and the key construction of the invention may be adapted for use in combination with spacer bars having various configurations such as oval, circular, square, etc having various interior opening or passage configurations.

An embodiment of the key construction of the invention is depicted in FIGS. 1-9. A first key member 30 includes a generally straight, axial rib 32 which extends and is located at the insertion end 31 of the first key member 30 and is dimensioned for insertion into the hollow interior of a bar 10 or 12. The key member 30 further includes projecting, generally transverse wings such as wings 34, 36, 38, 40, 42, and 44 distributed axially along the length of the rib 32.

Figure 9:
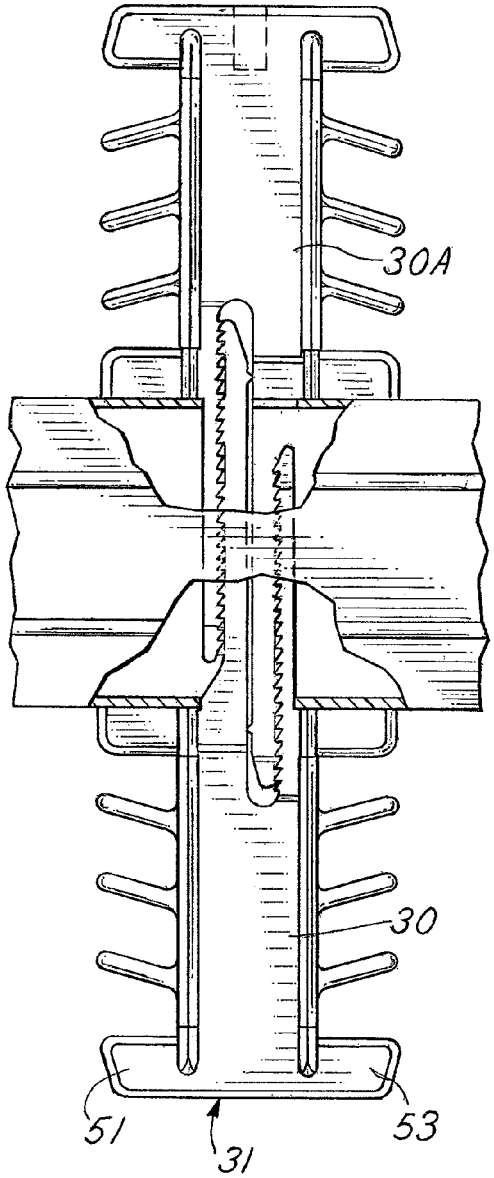
FIG. 9 is a top plan view of the key construction wherein two key members are joined and thereby connect or join spacer or muntin bars.

The rib 32 has a longitudinal dimension and lateral projecting wings and ribs or ridges which enable key 30 to snugly fit and be inserted into the hollow open end of a spacer bar 10 or 12. In the embodiment, the rib 32 is a generally planar member with parallel, spaced bottom side and top side, axially extending ridges 37, 39, 41, 43 having a cumulative vertical height approximately equal to the height dimension between the bottom and top walls 20 and 22 of the spacer bar 10. The rib 32 preferably includes generally medial, transverse side wings 48, 50 extending laterally in opposite directions from rib 32. Wings 48 and/or 50 are provided to limit the movement of key members 30 as shown in FIG. 9. The rib 32 includes draft angles of ridges 37, 39, 41, 53, which increase extending upwardly or dimensionally toward the wings 48, 50 to guide insertion into spacer bar 10 and provide a tight fit. Insertion of the key member 30 into the spacer bar 10 is at least in part controlled by the draft angle which causes the frictional positioning of the key member 30 into the spacer bar 10 to be more difficult upon further insertion of the key construction 30. Also, outer end wings 51, 53 serve a similar function and facilitate alignment and fit of the key member in spacer bar 10.

The key member 30 is generally a unitary molded element, for example, constructed from glass filled nylon. Thus, the wings, for example, wing 34, typically form an acute angle with the sidewall of the rib 32. In the embodiment shown, angle 54 is provided to accommodate deformation of the wing 36 as the key construction or key 30 is inserted into the passage defined within the spacer bar 10. The wing 36 and symmetrically opposite side wing 42 are elastic members which upon insertion will deform in the direction of the arrow in FIG. 3 as the key construction is inserted into a space bar 10. Upon placement of the key construction 30 within the hollow end of the spacer bar 10, the wings 36 and 38 will elastically spread and tend to frictionally engage the interior side walls 16 and 18 and thus hold the key construction 30 in position within the spacer bar 10. The transverse wings 51 and 53 at the outside or extreme end of the rib 32 have a similar function.

Figure 4:
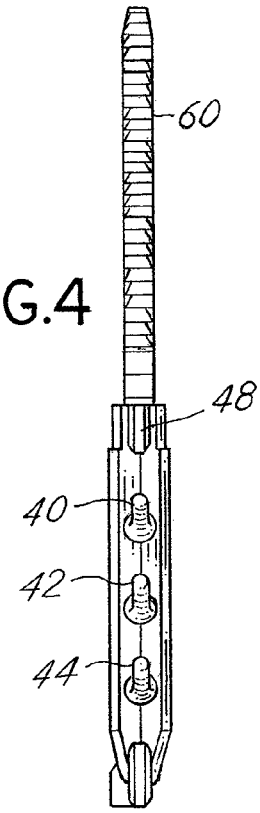
FIG. 4 is a right side elevation of the key member of FIG. 3.
Figure 7:
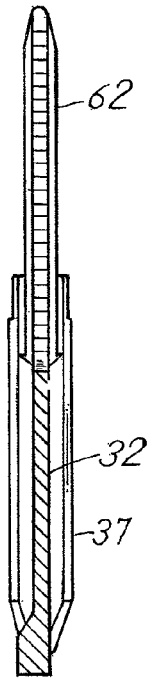
FIG. 7 is a sectional view of the key member of FIG. 3 along the line 7-7.
Figure 3:
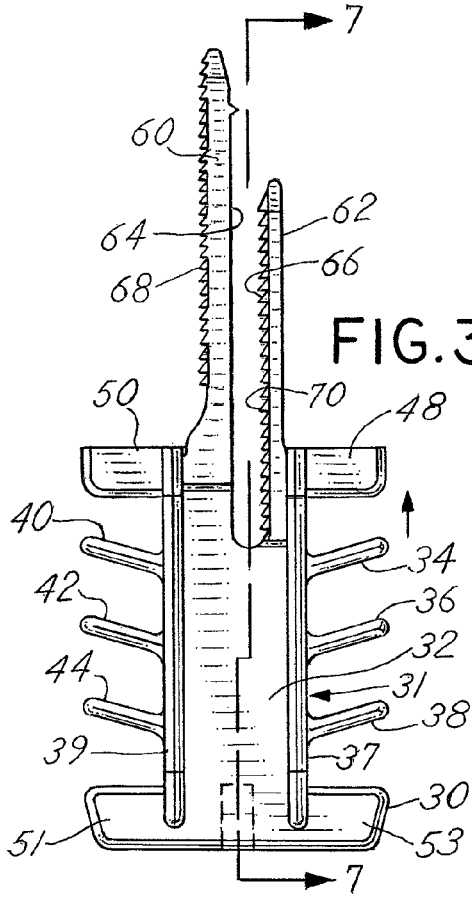
FIG. 3 is a top plan view of a key members of the key construction of the invention.
Figure 5:
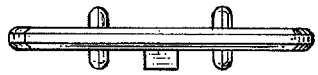
FIG. 5 is an end elevation of the key member of FIG. 3.
Figure 6:
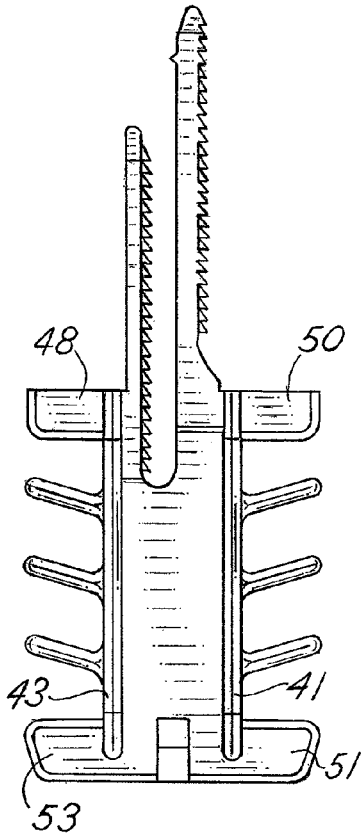
FIG. 6 is a bottom plan view of the key member of FIG. 3.
Figure 8:
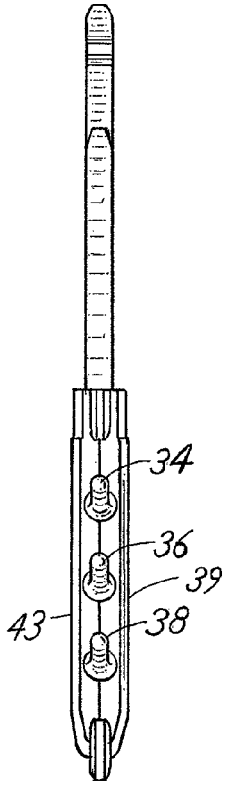
FIG. 8 is a left side elevation of the key member of FIG. 3.

In the embodiment, all of the wings 36, 38, 40, 42, 44 and 34 are generally of the same size and configuration although they may project in different angular relationships with respect to the center or axial rib 32. Further, the height of the wings, 34, 36, 38, 40, 42 and 44 is substantially equal as shown in FIG. 4 and is less than the vertical height of the center or axial rib 32. This construction enables the free flow of gas through the connection of the spacer bars 10 and 12.

The figures further illustrate the interlocking end construction 33 of the key member 30. It is to be noted that the key member 30 is a single unitary element or member which is designed to interlock with a like member 30A in order to join spacer bars 10, 12 either directly or to join spacer bars 10, 12 that form a joint or connection with a transverse or angled spacer bar 12A utilized in a dual pane window construction. This interlocking arrangement is depicted, for example, in FIG. 9 and the insertion and positioning of a key member, such as key member 30, within a spacer bar or muntin bar is illustrated as well as in FIG. 1.

A feature of the key member 30 which enables the joinder with a like key member 30A is associated with the utilization of axially projecting prongs or rib members and, in particular, a first axially projecting prong or rib member 60 generally parallel to the axis 14 and spaced from a second generally parallel axially extending prong or rib member 62. The first axially extending rib member 60 includes an inside face 64 which is generally co-axial with the centerline axis 14 of the key member 30. Typically this face or surface 64 is in opposed relation to an interior face or inside face 66 of the second rib member 62. The rib members 60 and 62 are spaced laterally from one another approximately the maximum width of the first rib member 60. This enables the insertion of the first rib member 60 of one key 30 into the space defined between the first rib member 60 and the second rib member 62 of second key 30A. Means for interlocking or, in other words, interlocking elements are provided to enable the maintenance of the insertion of the first rib member 60 into the space between the first rib member 60 and the second rib member 62.

By way of example, but not limitation, the interlocking element depicted in the embodiment of the invention includes serrations or teeth such as serrations 68 on the outside face or outside surface of the first rib member 60 which are cooperative with and designed to engage with serrations or teeth 70 on the opposed inside surface 66 of the second rib member 62. It is to be noted that the axial extent of the first rib member 60 exceeds the axial extent of the second rib member 62. As a consequence, the opening or passage defined between the first rib member 60 and the second rib member 62 extends axially into the region between the wings 48 and 50. The degree of the axially extending passageway between the first rib member 60 and second rib member ensures adjustability of the spacing of joined key members such as key members 30 and 30A. The axial extent of the passage or slot between prongs 60, 62 generally exceeds the length of the central prong 60.

In the embodiment depicted, therefore, the key construction is essentially symmetrical with respect to the axial longitudinal axis 14 except for the design associated with the first rib member 60 and second rib member 62. However, the design of the first rib member 60 and second rib member 62 enable the joinder of a first key member 30 with a second key member 30A as for example, shown in FIG. 9. That is, because the key members 30 and 30A are essentially identical with respect to the winged or insertion end which is inserted within or into spacer bars 10, 12. The key members 30 and 30A may be joined by merely rotating there orientation 180° with respect to one another and then inserting them (their prongs or ribs 60, 62) together for example, as shown in FIG. 9.

As another feature of the invention, the wings 48 and 50 are provided to limit the outer extent and positioning of the key members 30 and 30A. Thus, as shown in FIG. 9. A key member 30A may be retained within a spacer bar with the prongs 60 and 62 projecting therefrom and extending into or through a transverse spacer bar 12A having a passageway therein to enable joinder of the rib members 60 and 62 of a first key member 30 with rib members 60 and 62 of the second key member 30A. The key members of the invention may be utilized to join abutting spacer bars or may be used to connect spacer bars such as spacer bars 10 and 12 to transverse spacer bars such as a spacer bar 12A in FIG. 9. This is enabled by virtue of the fact that the prongs or rib members 60 and 62 can be inserted into a small side opening or passage within the spacer bar 12A and then engage one with the other. Adjustment of the length of the spacer bar rib member 60 and 62 and the manner in which they engage one with the other is dependent upon the width for example, of a transverse spacer bar 12A that can be co-joined with connected spacer bar such as spacer bars 10 and 12 again as depicted in phantom in FIG. 9.

Another advantage or feature of the embodiment depicted is the fact that the material utilized in the manufacture of the keys is adequately plastic enabling the joinder of spacer bars which form curves or other shapes other than right angle or transverse joinder. Other aspects of the embodiment include the ability to provide alternate lateral side wing designs such as wing 36 as well as wings 48 and 50 end wings 51, 53 to be sized for cooperation with multiple types and shapes of spacer bars or muntin bars having unique interior passages or openings.

While there has been set forth an embodiment of the invention, it is to be understood that the invention is not limited to the noted embodiment. Alternations of the features and changes to the materials as well as the dimensions and the design of the ribs, wings and other features of the invention are not limiting features. The wings such as wings 34, 36, 38, 40, 42 and 44 may be asymmetrical in their arrangement. The number and location of those wings may be altered. The location of the various ribs may be altered. The inter-engaging relationship of the axially extending first and second prongs such as 60 and 62 may be altered and additional or fewer prongs may be incorporated for interlocking purposes. Thus the invention is to be limited only by the following claims and equivalents thereof.

What is claimed is:

1. A key construction for joinder of first and second hollow muntin bars, each muntin bar having a hollow end, said construction comprising, in combination:

a first key member including an insertion end and an interlocking end;

a separate second key member including an insertion end and an interlocking end;

each said key member including a longitudinal axis, the insertion end of each key member comprising at least one axially extending support rib, said support rib including at least one pair of oppositely extending, generally transversely extending wings, said wings sized and positioned for frictional engagement into the hollow end of a muntin bar; and said interlocking ends of the first and second key members each including a substantially identical, axially projecting prong, said axially projecting prongs each including a surface with interlocking elements, said interlocking elements of said first and second prongs engaged with each other whereby said first and second key members are joined together.

2. The key construction of claim 1 wherein said each key member includes first and second interlocking axially projecting prongs, each of said prongs including axially transverse serrations for adjustable interlocking of the prongs of said first and second key members.

3. The key construction of claim 1 wherein the interlocking end of said each key member includes first and a second laterally spaced elongate prong extending axially from the insertion end of said key member, one of said first and second prongs of each key member being offset laterally from an axial centerline of said insertion end of each key member.

4. The key construction of claim 1 wherein the key members are fabricated from a plastic material.

5. The key construction of claim 1 further comprising with first and second hollow muntin bars.

6. The key construction of claim 1 further comprising with spaced, open ended, first and second hollow muntin bars.

7. A key construction for joinder of first and second hollow muntin bars, each muntin bar having a hollow end, said construction comprising, in combination:

a first key member including an insertion end and an interlocking end, said insertion end including a frictional engagement element means to engage and retain the first key member in the hollow end of a first muntin bar;

a separate second key member including an insertion end and an interlocking end, said insertion end including a frictional engagement element means to engage and retain the second key member in the hollow end of a second muntin bar; and said interlocking ends of the first and second key members each including a first axially extending prong and a second axially extending prong, said first and second prongs laterally spaced from each other by a dimension generally equal to the maximum width of the first prong, said first prong having a first lateral side and a second opposite lateral side, said first lateral side generally coincident with a centerline longitudinal axially extending axis of said key member.

8. The key construction of claim 7 wherein the first lateral side of the first prong is spaced from and opposed to a lateral side of the second prong, and the second lateral side of the first prong and the lateral side of the second prong include at least one interlocking element which by insertion of the first prong of the second key member intermediate the first prong and second prong of the first key member interlocks a prong of one of said key members to a prong of the other key member.

9. A key construction for joinder of first and second hollow muntin bars, each muntin bar having a hollow end, said construction comprising, in combination:

a first key member including an insertion end and an interlocking end, said insertion end including a frictional engagement element means to engage and retain the first key member in the hollow end of a first muntin bar;

a separate second key member including an insertion end and an interlocking end, said insertion end including a frictional engagement element means to engage and retain the second key member in the hollow end of a second muntin bar; and said interlocking ends of the first and second key members each including a substantially identical, axially projecting prong, said axially projecting prongs each including a surface with interlocking elements, said interlocking elements of said first and second prongs engaged with each other whereby said first and second key members are joined together wherein one of the projecting elongate prongs of one of said key members extends axially from the insertion end, with an outside face being generally aligned with an axial centerline of said insertion end of said one of said key members.

10. A key construction for joinder of hollow muntin bars, comprising, in combination:

a key member including an insertion end and an interlocking end, said insertion end including a configuration for frictionally engaging the first key member into the hollow end of a first muntin bar;

said key member including a longitudinal axis, the insertion end of said key member comprising at least one axially extending support rib, said support rib including at least one pair of oppositely extending, generally transversely extending wings, said wings sized and positioned for frictional engagement into the hollow end of a muntin bar;

said key member projection end including a first axially extending prong and a second axially extending prong, said first and second prongs laterally spaced from each other by a dimension generally equal to the maximum width of the first prong, said first prong having a first lateral side and a second opposite lateral side, said first lateral side generally coincident with a centerline longitudinal axially extending axis of said key member.

11. The key construction of claim 10 wherein the first lateral side of the first prong is spaced from and opposed to a lateral side of the second prong, and the second lateral side of the first prong and the lateral side of the second prong includes at least one interlocking element which by insertion of the first prong of a second key member intermediate the first prong and second prong of the first key member interlocks a prong of one of said key members to a prong of the other key member.

12. The key construction of claim 10 wherein said key member first and second interlocking axially projecting prongs include an axially transverse serrations for adjustable interlocking of the prongs.

13. The key construction of claim 10 wherein the projecting members comprise first and second spaced elongate prongs extending axially from the insertion end, one of said prongs being offset laterally from an axial centerline of said insertion end of said key member.

14. The key construction of claim 10 wherein the interlocking and comprises at least one elongate rib member extending axially from the insertion end, said one rib member having an outside face being generally aligned with an axial centerline of said insertion end.

15. The key construction of claim 10 wherein the key member is fabricated from a plastic material.

16. The key construction of claim 10 in combination with hollow muntin bars.

17. The key construction of claim 10 in combination with a spaced, open ended hollow muntin bars.

18. A key construction for joinder of first and second generally hollow muntin bars, comprising, in combination:

a first key member including an insertion end and an interlocking end, said insertion end including a configuration for frictionally engaging the first key member into the hollow end of a first muntin bar;

a second key member including an insertion end and an interlocking end, said insertion end including a configuration for frictionally engaging the second key member into the hollow end of a second muntin bar;

said interlocking end of the first and second key members being substantially identical and comprising an axially projecting first prong, said axially projecting first prongs engageable by interlocking for holding the first and second key members joined together in combination; and wherein each key member interlocking end includes a second axially extending prong, said first and second prongs of each key member laterally spaced from each other by a dimension generally equal to the maximum width of the first prong, said first prong having a first lateral side and a second opposite lateral side, said first lateral side generally coincident with a centerline longitudinal axially extending axis of said key member.

19. A key construction for joinder of first and second generally hollow muntin bars, comprising, in combination:

a first key member including an insertion end and an interlocking end, said insertion end including a configuration for frictionally engaging the first key member into the hollow end of a first muntin bar;

a second key member including an insertion end and an interlocking end, said insertion end including a configuration for frictionally engaging the second key member into the hollow end of a second muntin bar;

said interlocking end of the first and second key members being substantially identical and comprising an axially projecting first prong, said axially extending first prongs engageable by interlocking for holding the first and second key members joined together in combination; and wherein the projecting prongs comprise at least one elongate prong extending axially from the insertion end, said one elongate prong having an outside face generally aligned with an axial centerline of said insertion end.

20. A key construction for joinder of first and second generally hollow muntin bars, comprising, in combination:

a first key member including an insertion end and an interlocking end, said insertion end including a configuration for frictionally engaging the first key member into the hollow end of a first muntin bar;

a second key member including an insertion end and an interlocking end, said insertion end including a configuration for frictionally engaging the second key member into the hollow end of a second muntin bar;

said interlocking end of the first and second key members being substantially identical and comprising an axially extending first prong, said axially first extending prongs of said first and second key members engageable by interlocking for holding the first and second key members joined together in combination, and one of said first and second prongs being offset laterally from an axial centerline of said insertion end of each key member.

21. A key construction for joinder of hollow muntin bars, comprising, in combination:

a first key member including an insertion end and an interlocking end, said insertion end including at least one frictional engagement member means to retain the first key member in the hollow end of a first muntin bar;

a second key member including an insertion end and an interlocking end, said insertion end including at least one frictional engagement member means to retain the second key member in the hollow end of a second muntin bar; and said interlocking end of one of the first and second key members comprising a first axially projecting prong, said axially projecting first prong including a surface with serrations; and the other of one of said key members including a second axially projecting prong substantially identical to said first axially projecting prong, said serrations of said first and second axially projecting prongs engaged with each other whereby the first and second key members are joined.

* * * * *